US006952545B2

(12) United States Patent
Baek

(10) Patent No.: US 6,952,545 B2
(45) Date of Patent: Oct. 4, 2005

(54) OPC UNIT EXCHANGING APPARATUS

(75) Inventor: Chung-guk Baek, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 12 days.

(21) Appl. No.: 10/438,868

(22) Filed: May 16, 2003

(65) Prior Publication Data

US 2004/0005168 A1 Jan. 8, 2004

(30) Foreign Application Priority Data

Jul. 2, 2002 (KR) ..... 2002-38052

(51) Int. Cl.[7] ..... G03G 21/16
(52) U.S. Cl. ..... 399/116; 399/126
(58) Field of Search ..... 399/113, 119, 399/126, 111, 116

(56) References Cited

U.S. PATENT DOCUMENTS 4,339,196 A * 7/1982 Beck et al. ..... 399/119
4,845,523 A * 7/1989 Miyaji ..... 399/113
4,939,547 A * 7/1990 Miyaji et al.
4,989,037 A * 1/1991 Nagatsuna ..... 399/119
5,089,849 A * 2/1992 Hiraoka ..... 399/119
5,369,475 A * 11/1994 Kashiwagi ..... 399/119
5,414,493 A * 5/1995 Fujii et al. ..... 399/119
5,471,286 A * 11/1995 Tanaka

FOREIGN PATENT DOCUMENTS

JP 62115469 A * 5/1987 ..... G03G/15/00
JP 63100476 A * 5/1988 ..... G03G/15/01
JP 2000242059 A * 9/2000 ..... G03G/15/01

* cited by examiner

*Primary Examiner*—Susan Lee
(74) *Attorney, Agent, or Firm*—Staas & Halsey LLP

(57) ABSTRACT

An OPC unit exchanging apparatus of a printer includes an organic photo conductor (OPC) unit; a developing cartridge including a developing roller and contacting the OPC unit; a separating unit to separate the OPC unit and developing cartridge by a predetermined distance; a locking unit to settle the developing cartridge at the predetermined distance away from the OPC unit; an unlocking unit to unlock the developing cartridge locked by the locking unit; and a returning unit to return the developing cartridge so that the developing cartridge contacts the OPC unit.

20 Claims, 5 Drawing Sheets

OPC UNIT EXCHANGING APPARATUS

CROSS-REFERENCE TO RELATED APPLICATIONS

This application claims the benefit of Korean Patent Application No. 2002-38052 filed Jul. 2, 2002 in the Korean Industrial Property Office, the disclosure of which is incorporated herein by reference.

BACKGROUND OF THE INVENTION

1. Field of the Invention

The present invention relates to a printer, and more particularly, to an organic photo conductor (OPC) unit exchanging apparatus of an electro-photographic printer, which allows a user to exchange the OPC unit with ease.

2. Description of the Related Art

Generally, a printer has an organic photo conductor (OPC) unit to receive a digital image signal from a laser scanning unit (LSU) and to form an elelctrostatic latent image, a developing cartridge including a developing roller to develop the electrostatic latent image of the OPC unit using toner, a transfer belt to transfer the developed image of the OPC unit on a recoding paper, a printer body to protect these parts, and an upper cover and a rear cover.

The OPC unit has to be exchanged after being used for a while. When the OPC unit is pulled upwardly to be exchanged, the OPC unit is caught by the transfer belt and the developing cartridge of the upper part of the OPC unit. For the OPC unit to be easily exchanged, both the transfer belt and the developing cartridge should be a predetermined distance apart from the OPC unit.

As shown in FIG. 1, a printer includes an OPC unit 87 with an OPC handle 88, a developing cartridge 82 having a developing roller 83 contacting the OPC unit 87, a body 81, an upper cover 80 and a rear cover 84 covering these parts.

Therefore, for a user to exchange the OPC unit 87 in a conventional printer, the user has to open the upper cover 80 and the rear cover 84 disposed at the rear of the developing cartridge 82. After that, the user has to retreat the developing cartridge 82 with his or her hand and leave a space from the OPC unit 87 in order to prevent the OPC unit 87 from being caught when the OPC unit 87 is pulled upwardly. Next, the user has to separate the transfer belt 86 and the OPC unit 87 by grabbing the OPC handle 88.

As described so far, in the conventional printer the developing cartridge 82 should be retreated and spaced apart from the OPC unit 87 when the OPC unit 87 is exchanged. At this time, the user has to open the rear cover 84 and pull the developing cartridge 82 with his or her hand. Thus, the user has been inconvenienced by necessarily having to open the rear cover 84 of the developing cartridge 82 and pull the developing cartridge 82 with his or her hand to exchange the OPC unit 87.

SUMMARY OF THE INVENTION

The present invention has been made to overcome the above-mentioned problem of the related art. Accordingly, it is an object of the present invention to provide an OPC unit exchanging apparatus capable of enhancing a user's convenience as the exchanging operation is simplified when the user exchanges the OPC unit of a printer.

Additional objects and advantageous of the invention will be set forth in part in the description which follows and, in part, will be obvious from the description, or may be learned by practice of the invention.

According to the present invention, the above and or other objects are accomplished by an OPC unit exchanging apparatus of a printer, including: an organic photo conductor (OPC) unit; a developing cartridge including a developing roller and contacting with the OPC unit; a separating unit to separate the OPC unit and the developing cartridge by a predetermined distance; a locking unit to settle the developing cartridge away from the OPC unit by a predetermined distance; an unlocking unit to unlock the developing cartridge locked by the locking unit; and a returning unit to return the developing cartridge so that the developing cartridge contacts the OPC unit.

The separating unit comprises an OPC handle movably disposed at the OPC unit and a plurality of first members, each first member having one side fixed at a developing roller shaft and the other side protruding towards the OPC handle.

The locking unit comprises a lever having a locking recession, a resilient body disposed at one lower end of the lever and pushing that side of the lever upwardly, and a guide roller disposed at one side of the developing cartridge and settled by being locked at the locking recession.

The unlocking unit comprises second members movably disposed at an upper frame and a protrusion protruding downwardly at a lower side of the upper cover. The returning unit comprises resilient members disposed at one side of the developing cartridge.

DESCRIPTION OF THE PREFERRED EMBODIMENT

Figure 1:
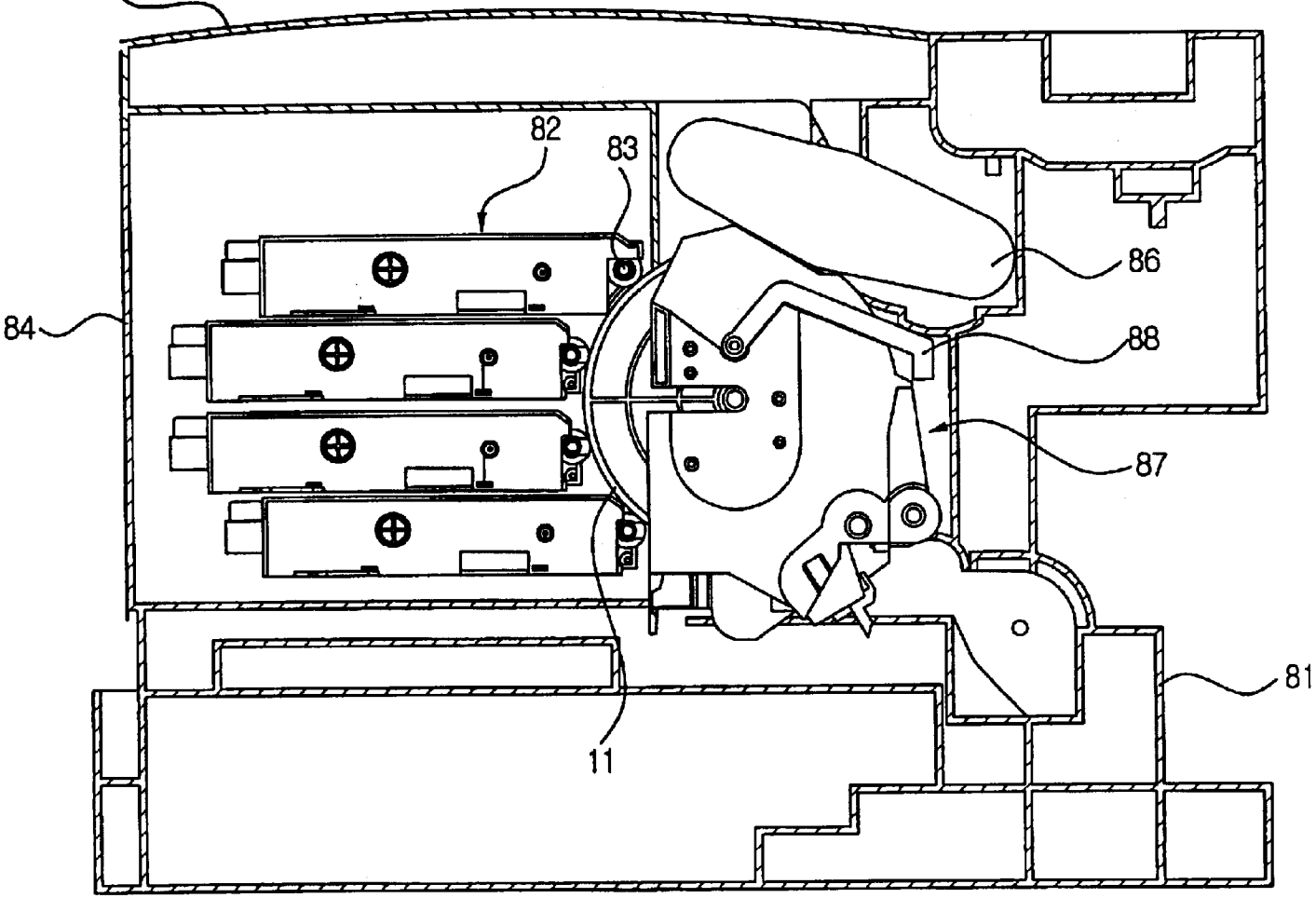
FIG. 1 (RELATED ART)
FIG. 1 is a front view schematically showing a color printer to describe the process of exchanging a conventional OPC unit.

Reference will now be made in detail to an embodiment of an OPC unit exchanging apparatus. The present invention is described in greater detail with reference to the accompanying drawings, wherein like reference numerals refer to like elements throughout.

FIGS. 2 through 5 are front and perspective views schematically showing an embodiment of the present invention.

Figure 2:
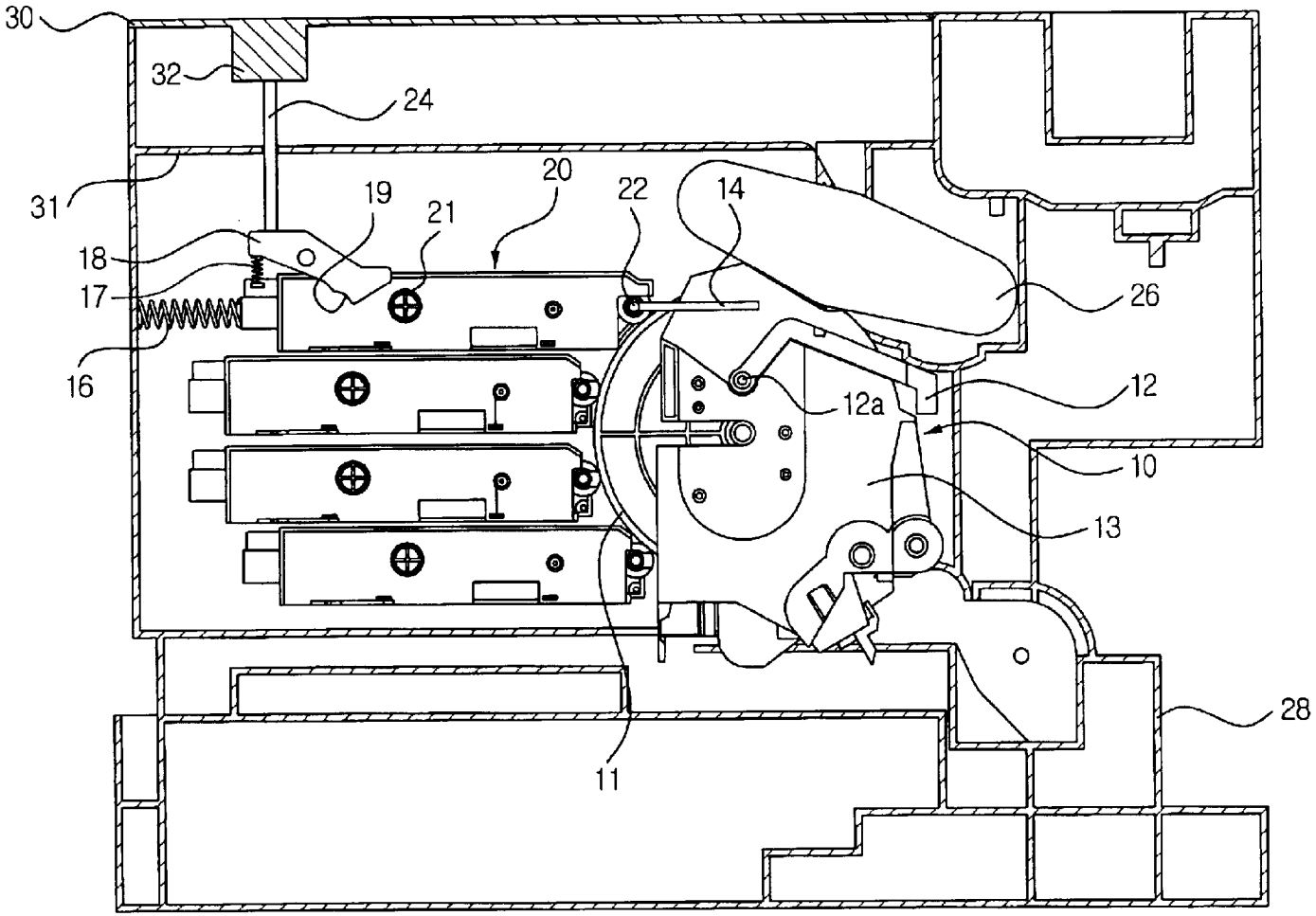
FIG. 2 is a front view schematically showing a color printer of an OPC unit exchanging apparatus according to an embodiment of the present invention.

FIG. 2 is a front view of an OPC unit exchanging apparatus of a color printer according to an embodiment of the present invention.

As shown in FIG. 2, the color printer having the OPC unit exchanging apparatus includes an OPC unit 10, a developing cartridge 20 having a developing roller 22 contacting with the OPC unit 10, resilient members 16, an OPC handle 12, a protrusion 32 formed on an inner part of an upper cover 30 covering the respective parts, a lever 18, first members 14, and second members 24.

An OPC handle 12 is disposed in sides of the OPC unit 10. The end of the OPC handle 12 is hinged at a frame 13 protecting an OPC drum 11. The OPC handle 12 is able to swing on a hinge area 12*a*.

The developing roller 22 is disposed at one end of the developing cartridge 20, and resilient members 16 are disposed at the other end. Certain ends of the first members 14 are fixed at the opposite ends of a developing roller shaft, while the free ends of the first members 14 are extended towards the OPC unit 10. In addition, guide rollers 21 are disposed at both sides of the developing cartridge 20.

The center of the lever 18 is settled and moved at a frame (not shown) placed at the both sides of the developing cartridge 20 in the printer body 28, and a spring 17 is disposed at one lower end of the lever 18. The spring 17 is supported at a protruding area of a side frame (not shown) of the printer.

The second members 24 are movably disposed at an upper frame 31, and a protrusion 32 is protruding downwardly towards the upper part of the second members 24 from the inner part of the upper cover 30.

The OPC unit exchanging apparatus is divided into a separating unit, a locking unit, an unlocking unit, and a returning unit.

Figure 3:
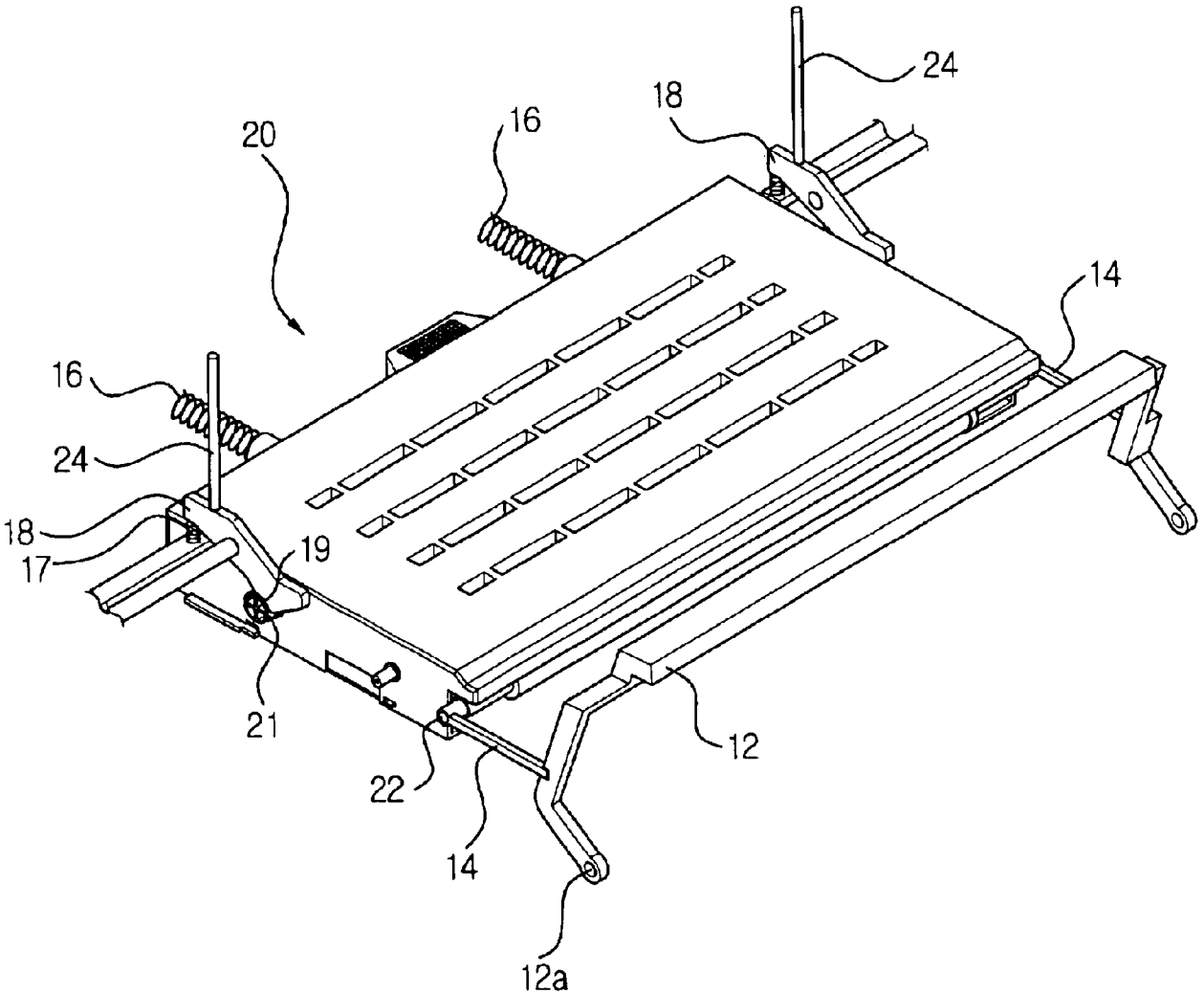
FIG. 3 is a perspective view showing one developing cartridge to explain the OPC unit exchanging unit of FIG. 2.

As shown in FIGS. 2 and 3, the separating unit comprises the OPC handle 12 and the first members 14. The locking unit comprises the guide rollers 21, the lever 18, and the spring 17.

The unlocking unit comprises the second members 24 and the protrusion 32 protruding towards the second members 24 from the inner part of the upper cover 30. The returning unit comprises of resilient members 16 disposed at one side of the developing cartridge 20.

Figure 4:
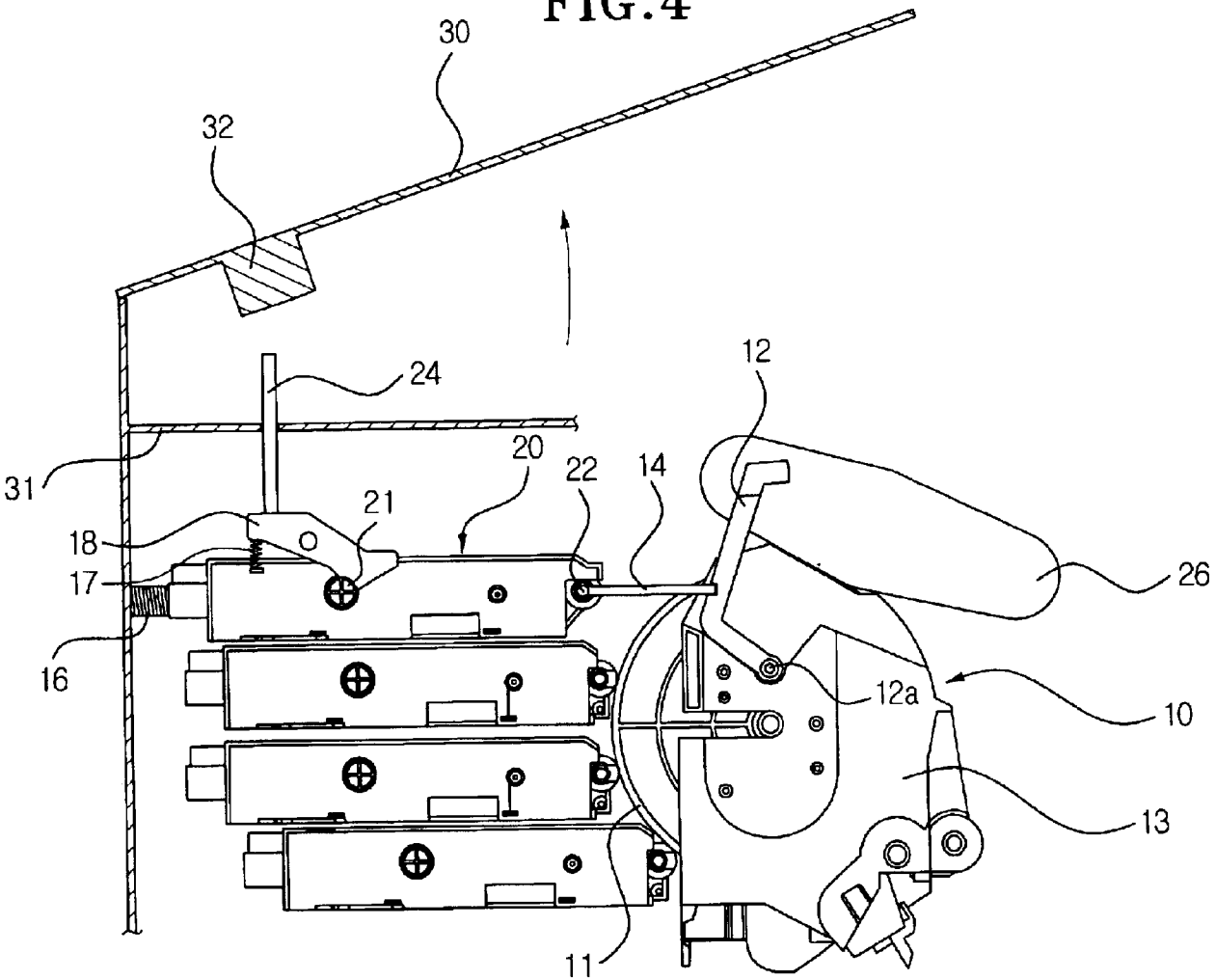
FIG. 4 is a front view explaining the operation of the OPC unit exchanging apparatus of FIG. 2 and schematically showing that during operation an upper cover is lifted and the OPC unit is pulled upwardly to separate the OPC unit.
Figure 5:
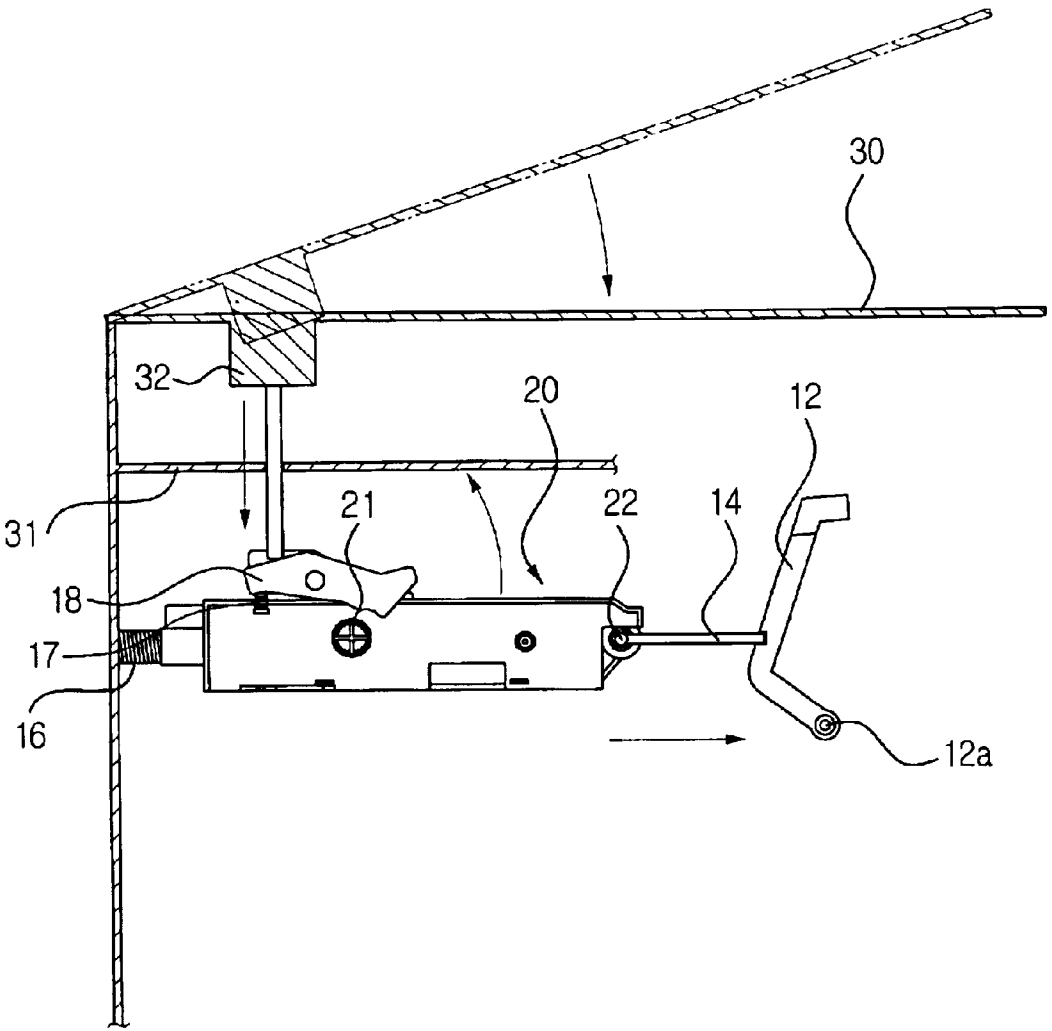
FIG. 5 is a front view explaining the operation of the OPC unit exchanging apparatus of FIG. 2 and schematically showing the operation of returning a developing cartridge by closing the upper cover and unlocking the developing cartridge after exchanging the OPC unit.

FIGS. 4 and 5 are front views showing operation of the OPC unit exchanging apparatus according to the present invention. As shown in FIG. 4, when the upper cover 30 of the printer is opened and the OPC handle 12 hinged at the frame 13 is pulled upwardly about the hinge area 12*a* to exchange the OPC unit 10, the OPC handle 12 pushes a side of the first members 14 which are fixed at their opposite side to the developing roller 22. Accordingly, the developing cartridge 20 is pushed with the developing roller 22.

When the developing cartridge 20 is pushed by a predetermined distance, the position of the developing cartridge 20 becomes fixed as the guide rollers 21 are locked at a locking unit 19 formed at the lever 18 by the recovery force of the spring 17 disposed at one lower end of the lever 18. When the developing cartridge 20 and OPC unit 10 are pushed away by a predetermined distance, the resilient members 16 disposed at one side of the developing cartridge 20 are compressed as shown in FIG. 4, and the user can lift the OPC unit 10 after removing a transfer belt 26.

When the user inserts a new OPC unit 10, replaces the transfer belt 26, and closes the upper cover 30 as shown in FIG. 5, the protrusion 32 protruding downwardly at the upper cover 30 hits one side of the second members 24. The second members 24 are pushed downwardly and hit the upper part of the lever 18 and the guide rollers 21 locked at the locking unit 19 are separated.

When the locking is released, the developing cartridge 20 is moved towards the OPC unit 10 due to a recovery force of the resilient members 16 compressed at one side of the developing cartridge 20, and the OPC unit 10 contacts the OPC drum 11.

The OPC unit exchanging apparatus according to the present invention can improve the reliability and the convenience of the product as the exchanging operation is simplified when the user exchanges the OPC unit of a printer.

Although a few preferred embodiments of the present invention have been described, it will be understood by those skilled in the art that the present invention should not be limited to the described preferred embodiment, but various changes and modifications can be made without departing from the spirit and scope of the present invention. Accordingly, the scope of the present invention is not limited within the described range but the scope of the invention is defined in following claims and their equivalents.

What is claimed is:

1. A method of facilitating exchanging an OPC unit of a printer, comprising:

moving an OPC handle into contact with a first members attached to a developing cartridge;

pushing the developing cartridge away from the OPC unit by a predetermined distance; and locking the developing cartridge at the predetermined distance from the OPC unit.

2. The method of claim 1, further comprising:

releasing the developing cartridge by contacting a locking lever with a plurality of second members that are forced downwardly when contacted by an upper cover of the printer with a downwardly extending protrusion.

3. An OPC unit exchanging apparatus of a printer comprising:

an organic photo conductor (OPC) unit;

a developing cartridge including a developing roller;

a separating unit to separate the OPC unit and the developing cartridge by a predetermined distance;

a locking unit to settle the developing cartridge at the predetermined distance away from the OPC unit;

an unlocking unit to unlock the developing cartridge locked by the locking unit; and a returning unit to return the developing cartridge.

4. The OPC unit exchanging apparatus of claim 3, wherein the separating unit comprises an OPC handle movably disposed at the OPC unit; and a plurality of first members each having one side fixed at a developing roller shaft and the other side protruding towards the OPC handle.

5. The OPC unit exchanging apparatus of claim 4, wherein the OPC handle is movably disposed in a rotatable manner and contacts the plurality of first members when moved, thereby moving the developing cartridge a predetermined distance.

6. The OPC unit exchanging apparatus of claim 3, wherein the locking unit comprises:

a lever having a locking recession;

a resilient body disposed at one lower end of the lever and pushing one side of the lever upwardly; and a guide roller disposed at one side of the developing cartridge and settled by being locked at the locking recession.

7. The OPC unit exchanging apparatus of claim 3, wherein the returning unit comprises resilient members disposed at one side of the developing cartridge.

8. The OPC unit exchanging apparatus of claim 4, wherein the locking unit comprises:

a lever having a locking recession;

a resilient body disposed at one lower end of the lever and pushing one side of the lever upwardly; and a guide roller disposed at one side of the developing cartridge and settled by being locked at the locking recession.

9. The OPC unit exchanging apparatus of claim 8, wherein:

the separating unit pushes the developing cartridge a predetermined distance, thereby engaging the locking unit;

the locking unit lever is raised upwardly at one end and locks the guide roller; and the locking unit lever places stress on the resilient body disposed at the other end of the lever.

10. The OPC unit exchanging apparatus of claim 8, herein the returning unit comprises resilient members disposed at one side of the developing cartridge.

11. The OPC unit exchanging apparatus of claim 10, wherein the resilient members comprise compression springs.

12. The OPC unit exchanging apparatus of claim 10, wherein the resilient members of the returning unit push the developing cartridge into contact with the OPC unit due to the recovery force of the resilient members; and the OPC unit contacts an OPC drum.

13. The OPC unit exchanging apparatus of claim 10, further comprising an upper cover to cover the OPC unit from above, wherein the unlocking unit comprises a second member movably disposed at an upper frame and a protrusion at a lower side of the upper cover protruding downwardly.

14. The OPC unit exchanging apparatus of claim 12, wherein the resilient members comprise compression springs.

15. The OPC unit exchanging apparatus of claim 4, further comprising an upper cover of the printer, wherein the unlocking unit comprises a second member movably disposed at an upper frame and a protrusion at a lower side of the upper cover protruding downwardly.

16. The OPC unit exchanging apparatus of claim 15, wherein:

the locking unit includes a lever having a locking recession which is movably disposed and unlocks the developing cartridge;

the protrusion at a lower side of the upper cover contacts the second member;

the second member is pushed downwardly and contacts an upper part of the locking unit lever.

17. An OPC unit exchanging apparatus of a printer comprising:

an organic photo conductor (OPC) unit;

a developing cartridge including a developing roller;

a unit to push the developing cartridge by a predetermined distance away from the OPC unit and lock the developing cartridge in position at the predetermined distance; and a unit to unlock the developing cartridge and return the developing cartridge.

18. An OPC unit exchanging apparatus of a printer comprising:

an organic photo conductor (OPC) unit:

a developing cartridge including a developing roller contacting the OPC unit;

a separating unit to separate the OPC unit and developing cartridge by a predetermined distance, wherein the separating unit comprises:

an OPC handle movably disposed at the OPC unit, and a plurality of first members each having one side fixed at a developing roller shaft and the other side protruding towards the OPC handle;

a locking unit to settle the developing cartridge a predetermined distance away from the OPC unit, wherein the locking unit comprises:

a lever having a locking recession, a resilient body disposed at one lower end of the lever and pushing one side of the lever upwardly, and a guide roller disposed at one side of the developing cartridge and settled by being locked at the locking recession;

an unlocking unit to unlock the developing cartridge locked by the locking unit, wherein the unlocking unit comprises:

a second member movably disposed at an upper frame, and a protrusion at a lower side of an upper cover of the printer protruding downwardly; and a returning unit to return the developing cartridge, wherein:

the returning unit is resilient members disposed at one side of the developing cartridge.

19. A method of facilitating an exchange of a first OPC unit with a second OPC unit in a printer, comprising:

opening an upper cover of the printer so as to allow a developing cartridge locking unit to rotate freely;

rotating an OPC handle, coupled to a developing cartridge, to cause the developing cartridge to retreat from the first OPC unit; and biasing the locking unit to rotate in a first direction so as to lock the retreated developing cartridge in place.

20. The method according to claim 19, wherein, once the first OPC unit has been replaced with the second OPC unit, the upper cover is closed and the locking unit is forced to rotate in a second direction so as to free a developing unit to move toward the second OPC unit.

* * * * *

UNITED STATES PATENT AND TRADEMARK OFFICE

CERTIFICATE OF CORRECTION

PATENT NO. : 6,952,545 B2
APPLICATION NO. : 10/438868
DATED : October 4, 2005
INVENTOR(S) : Chung-guk Baek It is certified that error appears in the above-identified patent and that said Letters Patent is hereby corrected as shown below:

Column 5, line 19, Claim 10, replace “herein” with --wherein--, therefor;

Column 6, line 9, Claim 18, replace “unit:” with --unit;--, therefor.

Signed and Sealed this

Eleventh Day of July, 2006

JON W. DUDAS
*Director of the United States Patent and Trademark Office*